US008523100B2

(12) United States Patent
Westphal et al.

(10) Patent No.: US 8,523,100 B2
(45) Date of Patent: Sep. 3, 2013

(54) BOBBIN HOLDER

(75) Inventors: Jan Westphal, Bünsdorf (DE); Claus Matthies, Wasbek (DE); Friedrich Lennemann, Neumünster (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 358 days.

(21) Appl. No.: 12/921,161

(22) PCT Filed: Mar. 2, 2009

(86) PCT No.: PCT/EP2009/052469

§ 371 (c)(1), (2), (4) Date: Nov. 30, 2010

(87) PCT Pub. No.: WO2009/109554

PCT Pub. Date: Sep. 11, 2009

(65) Prior Publication Data

US 2011/0062275 A1 Mar. 17, 2011

(30) Foreign Application Priority Data

Mar. 7, 2008 (DE) ..... 10 2008 013 125

(51) Int. Cl.
*B65H 75/24* (2006.01)

(52) U.S. Cl.
USPC ..... 242/571.8; 242/573.3; 242/573.7

(58) Field of Classification Search
CPC ..... B65H 54/543; B65H 75/245
USPC ..... 242/486.2, 571, 571.8, 572, 573, 242/573.1, 573.2, 573.3, 573.4, 573.7, 573.8, 242/573.9, 576.1
IPC ..... B65H 54/543,75/245
See application file for complete search history.

(56) References Cited

U.S. PATENT DOCUMENTS 4,241,883 A 12/1980 Benin

FOREIGN PATENT DOCUMENTS

| | | |
|---|---|---|
| DE | 628962 | 4/1936 |
| EP | 0078978 | 5/1983 |
| EP | 0850867 | 7/1998 |
| GB | 970526 | 9/1964 |
| GB | 1207819 | 10/1970 |
| JP | 1 209278 | 8/1989 |
| JP | 2000 264543 | 9/2000 |
| JP | 2003 276944 | 10/2003 |

OTHER PUBLICATIONS

Machine translation of JP 2003-276944 A.*

* cited by examiner

*Primary Examiner* — William E Dondero
(74) *Attorney, Agent, or Firm* — BainwoodHuang

(57) ABSTRACT

A bobbin holder for tensioning a bobbin tube and receiving a wound thread bobbin is presented. The bobbin holder includes a rotatable drive shaft that is connected to a drive with a bearing end thereof and that has a tensioning device for tensioning a bobbin tube on a tensioning end. The tensioning device includes a plurality of bobbin tubes on the periphery of the drive shaft and interposed tensioning rings. A tensioning piston guided on the free end of the drive shaft acts upon at least one of the bobbin tubes to deform the tensioning rings. In order to allow the use of high fatigue strength materials for the tensioning ring, the tensioning ring includes a continuous separating slot on the periphery, which extends between two opposite ring ends of the tensioning ring, deformation being essentially achieved by an expansion of the tensioning ring.

11 Claims, 2 Drawing Sheets

BOBBIN HOLDER

Figure 1:
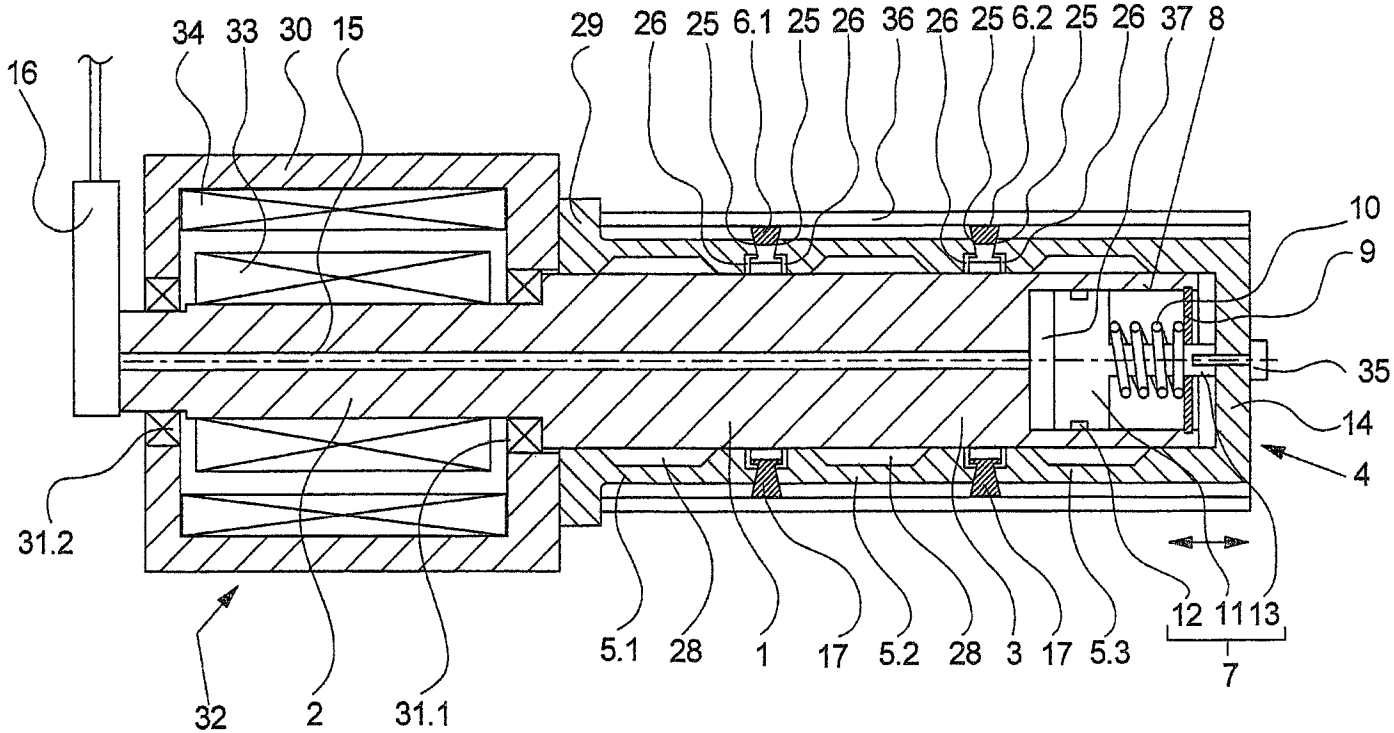

The invention relates to a bobbin holder for tensioning a bobbin tube and accommodating a wound yarn bobbin.

A generic bobbin holder is known from U.S. Pat. No. 4,458,850.

To wind up yarns, the wound yarn bobbins are usually wound and held on the circumference of a bobbin tube. The bobbin tubes are thereby held and driven by a bobbin holder, wherein the bobbin holders have detachable tensioning devices, so that the bobbin tubes can easily be changed at the start of the process and at the end of the process. In particular those bobbin holders have proven useful hereby in which the bobbin tubes are pushed onto a free projecting end of the bobbin holder. With bobbin holders of this type, the tensioning devices for fixing the bobbin tube are arranged on the circumference of a drive shaft.

A bobbin holder of this type is disclosed by U.S. Pat. No. 4,458,850. The tensioning device embodied on the circumference of a drive shaft is formed by several tension tubes and several tension rings, each of which has a full perimeter tension collar, which projects between the tension tubes. A tension tube held at the end of the drive shaft is connected to a tensioning piston, which is guided in a guide opening of the drive shaft. To fix a bobbin tube slipped over the tension tubes on the circumference, the tension tubes are displaced by means of the tensioning piston on the circumference of the drive shaft against a stop such that the tension rings arranged between the tension tubes are deformed and thus generate a clamping force on the inner circumference of the bobbin tubes. To this end the tension rings are made of a deformable very soft material, for example, an elastomer.

With the known bobbin holder, to achieve high clamping forces in particular for fixing the bobbin tube with wound yarn bobbin, high deformations on the tension ring must therefore be produced. The occurrences of material fatigue promoted thereby thus permit only short operating periods of bobbin holders of this type. A change of the tension rings due to material wear is already necessary after short operating times of the bobbin holder.

The object of the invention is therefore to create a bobbin holder of the generic type, in which the tensioning device securely braces tension tubes on the circumference of a drive shaft repetitively with high service lives.

This object is attained according to the invention in that the tension ring has a through separating slot on the circumference, which separating slot extends between two opposite ring ends of the tension ring.

Advantageous further developments of the invention are defined by the features and combinations of features of the respective subordinate claims.

The invention departs from the principle that the generation of the radial forces for fixing the bobbin tubes is produced solely by the material deformation of the tension ring. The invention essentially utilizes the geometric quality of the tension ring in order to produce radial forces for tensioning the bobbin tubes. To this end, the tension ring is severed at one point on the circumference so that two ring ends of the tension ring are produced lying opposite one another in a separating slot. A dilatation and spreading of the tension ring is thus possible, so that the essential tensile force occurs from the change of the geometric shape of the tension ring. Relatively strong and hard materials can thus be used for the tension ring, which have correspondingly long service lives.

In order to be able to realize a uniform package build even with higher circumferential speeds, according to an advantageous further development of the invention the tension ring is provided in a region lying opposite the separating slot at least with a mass-balancing opening. The masses of the tension ring held on the circumference of the drive shaft can thus be uniformly distributed, so that occurrences of greater imbalance are avoided.

The embodiment of the invention is particularly advantageous hereby in which the mass-balancing openings are dimensioned in their size and/or number such that a complete balancing of masses on the circumference of the drive shaft is produced in the tensioned state of the tension ring with spread ring ends. In any operating state of the bobbin holder, whether at the start of the winding up of a yarn at very high rotational speeds of the drive shaft or at the end of a winding up with correspondingly large bobbin weights, imbalances on the circumference of the drive shaft are avoided. In this manner high quality yarn bobbins can be wound on the circumference of the bobbin holder.

To maintain a sufficient stability of the tension ring, the separating slot in the tension ring is preferably embodied in an axially aligned manner and designed with a slot height of <2 mm. In principle, however, it is also possible to embody the separating slot in an inclined arrangement in the tension ring.

In order to obtain a spreading of the ring ends with axial loading of the tension ring, the tension ring is preferably embodied according to the advantageous further development of the invention in which the tension ring has respectively one tilted bearing area on both front faces of the tension collar, which bearing area interacts with a contact surface of one of the tension tube. Relatively high forces acting radially to spread the tension ring can thus be introduced in the tension collar, which leads to high fixing forces in the interior of the tension tube.

To this end, the bearing areas preferably have an angle of inclination to a perpendicular of the tension collar in the range of between 15° and 45°. The axial forces generated by the tensioning piston for bracing the tension ring can thus be kept relatively low.

According to a particularly advantageous further development of the invention, the tension ring has an inner cylindrical holding web, which is connected to the tension collar on the circumference in a central region such that the holding web forms projections to the front faces. Thus on the one hand a sufficient guidance can be realized on the circumference of the drive shaft, and on the other hand all of the parts of the tension ring are held on the drive shaft even in the event of a fracture of the tension ring.

In order not to impede the elasticity of the tension ring for spreading the ring ends, the holding web is interrupted on the circumference by several cut-outs, which are arranged distributed uniformly over the circumference. A sufficient elasticity of the tension ring is thus produced even with very strong materials, which make it possible to spread apart the tension ring.

To displace the tension tubes held on the circumference, one of the tension tubes is preferably embodied with a pot-shaped face end and guided directly on the free end of the drive shaft. A piston guided inside a guide opening of the drive shaft can thereby be connected in a simple manner to the tension tube on the face end of the drive shaft.

The tensioning piston is held in a tensioned position inside the guide opening preferably by means of a spring force of a compression spring, at which the tension tubes spread apart the tension rings. To release a bobbin tube on the circumference of the bobbin holder, the tensioning piston can be guided into a release position by means of a fluid force of a pressure fluid that can be optionally supplied.

In order to realize the most compact possible arrangement of the bobbin holder, which is usually held in an unwinding machine, the drive shaft is connected to a rotor of an electric motor on the mounted end according to a preferred embodiment of the invention. To this end, the rotor is arranged directly on the circumference of the drive shaft, wherein a stator of the electric motor lying opposite interacts with the rotor.

The drive shaft can thereby be supported preferably by several roller bearings, which are arranged on both sides of the rotor and held in a motor housing of the electric motor.

The bobbin holder according to the invention is described in more detail below based on an exemplary embodiment with reference to the attached figures.

They show:

FIG. 1 Diagrammatically a cross-sectional view of an exemplary embodiment of the bobbin holder according to the invention

FIG. 2 and

Figure 3:
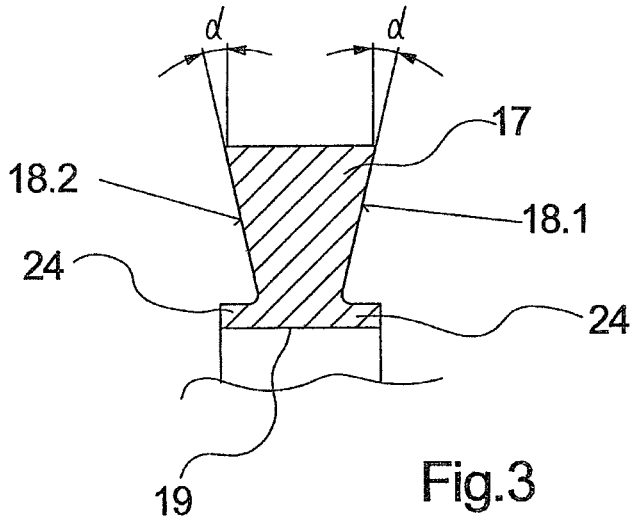

FIG. 3 Diagrammatically several views of a tension ring of the bobbin holder according to FIG. 1.

FIG. 1 shows diagrammatically a first exemplary embodiment of the bobbin holder according to the invention in a cross-sectional view. The bobbin holder has a drive shaft 1, which has a bearing end 2 and a projecting tension end 3. A tensioning device 4 is held on the projecting tension end 3 of the drive shaft 1 in order to tension a bobbin tube 36 on the circumference of the tension end 3 of the drive shaft 1.

The tensioning device 4 has several tension tubes 5.1, 5.2 and 5.3 arranged one behind the other on the circumference of the drive shaft 1. A tension ring 6.1 and 6.2 is respectively arranged between the tension tubes 5.1 and 5.2 and between the tension tubes 5.2 and 5.3. The tension rings 6.1 and 6.2 thereby project with respectively one tension collar 17 between the tension tubes 5.1, 5.2 and 5.3.

Figure 2:
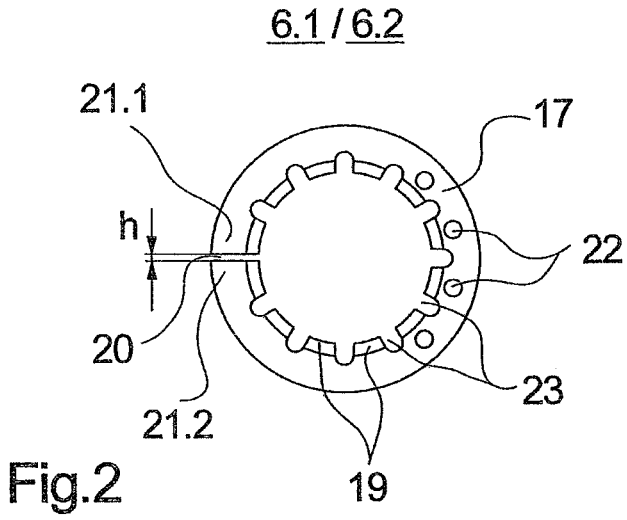

To describe the tension rings 6.1 and 6.2, firstly reference is made to FIGS. 2 and 3, in which one of the tension rings 6.1 is shown diagrammatically in several views. The following description applies to both figures, unless explicit reference is made to one of the figures.

The tension ring 6.1 has a full perimeter tension collar 17. The tension collar 17 is severed through at one point of the circumference by a separating slot 20. The separating slot 20 extends between the ring ends 21.1 and 21.2 lying opposite one another. The spacing between the ring ends 21.1 and 21.2 forms the height of the separating slot 20, which is labeled by lowercase h in FIG. 2. The separating slot 20 is embodied very narrowly in its height, and is preferably embodied to be smaller than 2 mm.

Several mass-balancing openings 22 are inserted in the tension collar 17 on the opposite side of the separating slot 20. The number and the size of the mass-balancing openings 22 is configured for a geometric shape of the tension ring, which arises with loading in the spread apart state of the ring ends 21.1 and 21.2. In the spread apart state of the tension ring 6.1, the ring ends 21.1 and 21.2 lie in the separating slot 20 with a greater spacing from one another so that a larger loss of mass through the separating slot 20 occurs on the circumference of the drive shaft on the side of the separating slots. To compensate for the loss of mass, several mass-balancing openings 22 are embodied on the opposite side of the separating slot 20, so that the tension ring 6.1 does not produce any imbalance on the circumference of the drive shaft.

As can be seen from FIG. 3, two bearing areas 18.1 and 18.2 lying opposite one another are embodied on the tension collar 17 of the tension ring. The bearing areas 18.1 and 18.2 have an angle of inclination $\alpha$ to a perpendicular. The angle of inclination $\alpha$ is embodied identically with both of the bearing areas 18.1 and 18.2 and is preferably in the range of 15° to 45°. The bearing areas 18.1 and 18.2 interact in the operating condition—as is explained below—with contact surfaces 25 of the tension tubes 5.1 and 5.3.

A full perimeter cylindrical holding web 19 is embodied in the interior of the tension ring 6.1, which holding web respectively forms a projection 24 to each front face of the tension ring 6.1. The holding web 19 is connected to the tension collar 17 in the center region.

As can be seen from the representation in FIG. 2, the holding web 19 as well as the tension collar 17 is severed at several points on the circumference by cut-outs 23. The cut-outs 23 are distributed uniformly on the circumference of the holding web 19. The holding web 19 is thereby severed into a plurality of segments. The size and the shape of the cut-outs 23 is dimensioned such that a sufficient elasticity of the tension ring is produced to spread apart the ring ends 21.1 and 21.2 despite the use of a strong material, for example, a hard plastic.

In FIG. 1 the tension ring 6.1 and the tension ring 6.2 embodied identically to the tension ring 6.1 are shown in a spread apart position to fix the bobbin tube 36. The tension rings 6.1 and 6.2 are held by the bobbin tubes 5.1, 5.2 and 5.3. The tension tube 5.1 facing towards the bearing end 2 of the drive shaft 1 is preferably fixed on the circumference of the drive shaft 1 and with a projecting collar forms a stop 29. On the face end facing towards the tension ring 6.1, the tension tube 5.1 has a contact surface 25 as well as an indentation 26 in order to render possible an area contact and bearing against the tension ring 6.1.

The adjoining tension tube 5.2 is guided on the circumference of the drive shaft 1 in a displaceable manner and has respectively one contact surface 25 and one indentation 26 on both face ends. The tension tube 5.2 bears with its left contact surface 25 against the tension ring 6.1 and with the right contact surface 25 against the tension ring 6.2.

The tension tube 5.3 guided on the end of the drive shaft 1 likewise has a contact surface 25 embodied opposite the tension ring 6.2 and an indentation 26. A pot-shaped face end 14 is embodied on the opposite front face of the tension tube 5.3, so that the tension tube 5.3 encloses the free end of the drive shaft 1 in a pot-shaped manner.

On the circumference of the drive shaft 1 the tension tubes 5.1, 5.2 and 5.3 have several material cut-outs 28. In particular with the tension tubes 5.2 and 5.3, small slide surfaces can thus be realized compared to the circumference of the drive shaft 1. Furthermore, unnecessary material accumulations on the circumference of the drive shaft 1 are avoided.

The face end 14 of the tension tube 5.3 is connected to a tensioning piston 7 via mounting apparatus 35. The tensioning piston 7 is embodied as a stepped piston and is guided in a guide opening 8 on the free front end of the drive shaft 1. To this end, the tensioning piston 7 has a guide section 11, which is guided in the guide opening 8 in a pressure-tight manner. A pressure chamber 37 is formed on the closed end of the guide opening 8 by a seal 12 provided on the circumference of the guide section 11, which pressure chamber acts on the front face of the guide section 11. The pressure chamber 37 is connected via a fluid channel 15 to a fluid connection 16 arranged on the bearing end 2 of the drive shaft 1.

To realize a larger piston area, there is alternatively also the option of attaching the seal 12 to the tension tube 5.3 so that the gap formed between the tension end 3 of the drive shaft 1 and the tension tube 5.3 is sealed. The pressure chamber 37 in this case would extend to the closed face end 14 of the tension tube 5.3.

In addition to the guide section 11, the tensioning piston 7 has a holding section 13 smaller in diameter, which projects with its free end out of the guide opening 8 and is firmly connected to the face end 14 of the tension tube 5.3. A compression spring 10 is held inside the guide opening 8 on the circumference of the holding section 13, which compression spring on the one hand is supported on a diameter step between the guide section 11 and the holding section 13 of the tensioning piston 7 and on the other hand is held by a retaining ring 9 fixed on the guide opening 8. The retaining ring 9 has an opening in the center, which opening is penetrated by the holding section 13 of the tensioning piston 7.

The drive shaft 1 is coupled on the bearing end 2 to an electric motor 32. To this end, a rotor 33 is attached on the circumference of the drive shaft 1, which rotor interacts with a stator 34 of the electric motor 32 lying opposite. At the side next to the rotor 33 respectively a roller bearing 31.1 and 31.2 are held in a motor housing 30, in which the drive shaft 1 is supported with the bearing end 2. The bearing end 2 of the drive shaft 1 is provided with several diameter steps to this end.

In order to push on and brace a bobbin tube 36 on the circumference of the bobbin holder at the beginning of a winding-up operation, the tensioning device 4 is held in a non-tensioned state. To this end, a pressure fluid is conducted into the fluid channel 15 and pressure chamber 37 via the fluid connection 16. The pressure fluid acting on the front face of the guide section 11 of the tensioning piston 7 generates a fluid force that displaces the tensioning piston 7 against the compression spring 10 in the direction of the free end of the drive shaft 1 into a release position. The tension tube 5.3 is hereby likewise displaced towards the free end of the drive shaft 1, so that the tension rings 6.1 and 6.2 are released from their bracing. The spreading apart of the tension rings 6.1 and 6.2 is released and the respective ring ends 21.1 and 21.2 bear against the circumference of the drive shaft 1 at a short distance from one another. In this state the bobbin tubes 36 on the bobbin holder are changed.

As soon as a bobbin tube 36 has been pushed onto the projecting end of the bobbin holder up to a stop 29, the tensioning device 4 is shifted into a tensioned state. To this end, the pressure fluid inside the pressure chamber 37 is shifted into a pressureless state so that the tensioning piston 7 is displaced into a tensioned position in the direction towards the bearing end 2 by the spring force of the compression spring 10. The tension tube 5.3 is thereby likewise displaced via the tensioning piston 7 in the direction of the stop 29, so that the tube package 5.1, 5.2 and 5.3 is braced with the tension rings 6.1 and 6.2 lying therebetween. The axial force introduced via the respective contact surfaces 25 of the tension tubes 5.1, 5.2 and 5.3 and bearing areas 18.1 and 18.2 of the tension rings 6.1 and 6.2 leads on the tension ring 6.1 and 6.2 to a spreading of the respective ring ends 21.1 and 21.2, wherein the respective tension collar 17 of the tension rings 6.1 and 6.2 is pressed radially outwards against the bobbin tube 36. The bobbin tube 36 is now fixed on the bobbin holder via the tension rings 6.1 and 6.2.

In order to wind up a yarn on the circumference of the tube, the drive shaft 1 is driven with the tensioning device 4 via the electric motor 32.

The embodiment shown in FIG. 1, in particular the embodiment of the tension ring shown in FIGS. 2 and 3, is by way of example. In principle, a tensioning device of this type can be realized with similar shapes of the tension ring, wherein it is essential hereby that the radial tensile force is generated essentially by a radial spreading of the ring ends of the tension ring.

LIST OF REFERENCE NUMBERS

1 Drive shaft
2 Bearing end
3 Tension end
4 Tensioning device
5.1, 5.2, 5.3 Tension tubes
6.1, 6.2 Tension ring
7 Tensioning piston
8 Guide opening
9 Retaining ring
10 Compression spring
11 Guide section
12 Seal
13 Holding section
14 Face end
15 Fluid channel
16 Fluid connection
17 Tension collar
18.1, 18.2 Bearing area
19 Holding web
20 Separating slot
21.1, 21.2 Ring end
22 Mass-balancing opening
23 Cut-out
24 Projection
25 Contact surface
26 Indentation
28 Material cut-out
29 Stop
30 Housing
31.1, 31.2 Roller bearing
32 Electric motor
33 Rotor
34 Stator
35 Mounting apparatus
36 Bobbin tube
37 Pressure chamber

The invention claimed is:

1. Bobbin holder for tensioning a bobbin tube and for accommodating a wound yarn bobbin with a rotatable drive shaft, which is connected to a drive on one supported end and which on a free end bears a tensioning device, wherein the tensioning device on the circumference of the drive shaft has several tension tubes and at least one tension ring arranged between the tension tubes, wherein the tension ring is embodied in a deformable manner and projects with a full perimeter tension collar between the tension tubes and wherein a tensioning piston guided on the free end of the drive shaft acts on at least one of the tension tubes, which is guided in a displaceable manner on the circumference of the drive shaft to deform the tension ring, the tension ring having a through separating slot on the circumference, which separating slot extends between two opposite ring ends of the tension ring, wherein the tension ring has respectively one tilted bearing area on both front faces of the tension collar, which bearing areas interact with the contact surfaces of the tension tubes, and wherein the tension ring has an inner cylindrical holding web, which is connected to the tension collar on the circumference in a center region such that the holding web forms projections to the front faces of the tension ring.

2. Bobbin holder according to claim 1, wherein the tension ring has at least one mass-balancing opening (22) in a region opposite the separating slot (20).

3. Bobbin holder according to claim 2, wherein the mass-balancing opening is dimensioned in its size and/or number such that a complete balancing of masses can be produced on the circumference of the drive shaft in the tensioned state of the tension ring with spread ring ends.

4. Bobbin holder according to claim 1, wherein the separating slot is aligned axially in the tension ring and in the non-tensioned state has a slot height of <2 mm.

5. Bobbin holder according to claim 1, wherein the bearing areas have an angle of inclination ($\alpha$) in the range between 15° and 45° to a perpendicular of the tension collar.

6. Bobbin holder according to claim 1, wherein the holding web is interrupted on the circumference by several cut-outs, which are arranged distributed uniformly over the circumference of the tension ring.

7. Bobbin holder according to claim 1, wherein one of the tension tubes is embodied with a pot-shaped face end and covers the free end of the drive shaft and that the pot-shaped face end of the tension tubes is connected to the tensioning piston, which is guided in a guide opening of the drive shaft.

8. Bobbin holder according to claim 7, wherein the tensioning piston is held inside the guide opening in a tensioned position by means of spring force of a compression spring and in a release position by means of a fluid force of a pressure fluid is capable of being supplied.

9. Bobbin holder according to claim 8, wherein the drive shaft has a fluid channel which is connected to a fluid connection on the supported end of the drive shaft and opens into the guide opening of the drive shaft.

10. Bobbin holder according to claim 1, wherein the drive shaft on the supported end on the circumference bears a rotor of an electric motor, which interacts with a stator of the electric motor lying opposite to drive the drive shaft.

11. Bobbin holder according to claim 10, wherein the drive shaft is supported by several roller bearings, which are arranged on both sides of the rotor and are held in a motor housing of the electric motor.

* * * * *